US008246274B1

(12) United States Patent
Hall et al.

(10) Patent No.: US 8,246,274 B1
(45) Date of Patent: Aug. 21, 2012

(54) EARTH FILL RETAINING WALL SYSTEM AND METHOD

(76) Inventors: H. Carl Hall, Arlington, WA (US); Howard Carl Hall, Arlington, WA (US)

( * ) Notice: Subject to any disclaimer, the term of this patent is extended or adjusted under 35 U.S.C. 154(b) by 75 days.

(21) Appl. No.: 12/552,930

(22) Filed: Sep. 2, 2009

Related U.S. Application Data

(60) Provisional application No. 61/190,841, filed on Sep. 2, 2008.

(51) Int. Cl.
*E02D 29/02* (2006.01)

(52) U.S. Cl. ..... 405/262; 405/284; 405/302.7

(58) Field of Classification Search ..... 405/16, 405/262, 272, 284, 287.1, 302.4, 302.6, 302.7
See application file for complete search history.

(56) References Cited

U.S. PATENT DOCUMENTS 4,572,711 A * 2/1986 Benson et al. ..... 405/286
4,960,349 A * 10/1990 Willibey et al. ..... 405/262
6,296,422 B1 * 10/2001 Ferraiolo ..... 405/262
6,769,222 B2 * 8/2004 Billante ..... 52/741.15
2003/0143026 A1 * 7/2003 Santha ..... 405/15

* cited by examiner

*Primary Examiner* — David Bagnell
*Assistant Examiner* — Benjamin Fiorello
(74) *Attorney, Agent, or Firm* — Dean A. Craine

(57) ABSTRACT

An earth fill retaining wall system that uses a removable L-shaped bracket and one or more support boards that temporarily holds the front surface of a mesh cover panel vertical aligned while backfilled with fill material. The brackets hold the mesh cover panel until tiers are stacked above. The weight of the stack tiers are used to hold the mesh cover panel on each lower tier in place. Once the above stacked tiers are formed, the brackets can be removed and reused. Attached to the lower end of the post and extending in the opposite direction of the base is an optional support shoe. A hole is formed in the shoe that receives a vertical stake or pin driven into the ground to temporarily hold the bracket in place. Attached to the post is a loop that attaches to a chain or cable used to pull the bracket forward.

1 Claim, 7 Drawing Sheets

EARTH FILL RETAINING WALL SYSTEM AND METHOD

COPYRIGHT NOTICE

Notice is hereby given that the following patent document contains original material which is subject to copyright protection. The copyright owner has no objection to the facsimile or digital download reproduction of all or part of the patent document, but otherwise reserves all copyrights whatsoever.

This utility patent application is based on and claims the filing date of the provisional patent application (Ser. No. 61/190,841) filed on Sep. 2, 2008.

BACKGROUND OF THE INVENTION

1. Field of the Invention

This invention pertains to the field of earth filled retaining walls systems and methods, and more particularly to retaining wall systems and methods designed to be constructed in environmentally sensitive areas.

2. Description of the Related Art

Roadways and trails are commonly constructed over or adjacent to rivers and streams. State and federal environmental laws and regulations control how the retaining walls will be constructed and what materials will be used. One of the most important restrictions is that construction of retainer walls shall have no, or minimal impact on the river or stream and to the surrounding beds. These laws and regulations also typically include provisions that prohibit the use of tools and forms that touch or disturb the river, stream or the surrounding beds.

Today, retaining walls are typically constructed by stacking concrete blocks in staggered horizontal rows (also called tiers) over a concrete footer and then backfill the blocks with soil and rock. In order to construct these retaining walls, staging areas have to be created where large delivery trucks and crane equipment can be offloaded and setup. Special forms have to be used to create the footing and other foundation structures needed to construct the retaining wall. The tools, forms and construction methods used to construct these retaining walls are often in violation of many state and federal regulations.

What is needed is an earth fill retaining wall system and that uses mostly natural materials, is relatively easy to construct, does not impact the river, stream or beds during construction, and does not require the use of large pieces of equipment to construct.

SUMMARY OF THE INVENTION

It is an object of the invention to provide a retaining wall system and construction method that can be used in environmentally sensitive areas where contact of the river, stream or beds are prohibited.

It is another object of the invention to provide a retaining wall system that uses reusable brackets and standard mesh cover panels to retain earth fill material.

It is further object of the invention to provide a system and method of constructing a retainer wall that is faster to construct than solid concrete retaining wall systems or concrete block retaining wall systems.

These and other objects are met by the earth fill retaining wall system and method disclosed herein that is used to construct a stepped, multi-tier retaining wall using a plurality of removable brackets, a plurality of support boards, a plurality of mesh cover panels, and earth fill material. Each bracket is a L-shaped structure that includes a vertical post which holds one or more support boards against the middle section of a mesh cover panel that bends upward and forms the front surface of the tier. Each bracket also includes a lower perpendicular base that extends into the earth fill material. During assembly, the brackets are spaced apart and positioned along the front face of the tier of the retaining wall to be constructed. The lower section of the mesh cover panel is then horizontally positioned over the ground and over the bases used with the brackets to form the tier. Earth fill material is then deposited over the lower section of the mesh cover panel which temporarily holds the mesh cover panel in place. Eventually more earth fill material is added so that the weight of the earth fill material presses downward and securely holds the bases of the brackets in place. Also attached to the lower end of the post and extending in front of the post in the opposite direction of the base is an optional, forward extending shoe. A hole is formed in the shoe which is designed to received a vertical stake or pin that is manually driven into the ground to temporarily hold the bracket in place When the lower section of the mesh cover panel is laid out to cover the ground and the bases, it is then bent upward against the inside surfaces of the support boards. Earth fill material is gradually placed behind the support boards and over the middle section. A roller is then operated over the earth fill material to compact it. When the level of earth fill material reaches the top of the post or the top edge of the support boards, the upper section of the mesh cover panel is then pulled rearward and extended over the top layer of the earth fill material. In the preferred embodiment, the upper section of the mesh cover panel is substantially parallel to the lower section of the mesh cover panel.

To form another offset tier over the first tier, another set of brackets, support boards and mesh cover panel are selected. The lower section of the second mesh cover panel is laid over the upper section of the mesh cover panel used on the lower tier. In the preferred embodiment, the new brackets is positioned so that the posts are placed inward from the front surface of the lower tier to create a 'stepped' retaining wall structure. Support boards are then placed against the inside surface of the brackets, and the middle section of the second mesh cover panel is then pulled forward and bend upward along the inside surfaces of the support panels. Suitable earth fill material is then deposited over the second mesh cover panel and a roller is used to compact the earth fill material. When the second tier is at or near the top of the bracket or the support boards, the second mesh cover panel is pulled rearward. The method for constructing each tier is then repeated until the overall desired height of the retaining wall is reached. Over the top tier, a thick layer of earth fill material may be used hold the last mesh cover panel in place.

In summary, the bracket is designed to temporarily hold the front face of the main cover panel in position until adjacent retaining wall tier are stacked and assembled above. The brackets, the support boards, and the mesh cover panels are quickly installed so that the entire retaining wall can be constructed in approximately 50% less time than conventional earth fill retaining wall construction methods. Because the weight of the earth fill material is used to partially hold the bracket in place, no additional supports or forms that usually extend forward and touch and disturb the nearby river, stream or adjacent bed are not needed.

DESCRIPTION OF THE PREFERRED EMBODIMENT(S)

Figure 1:
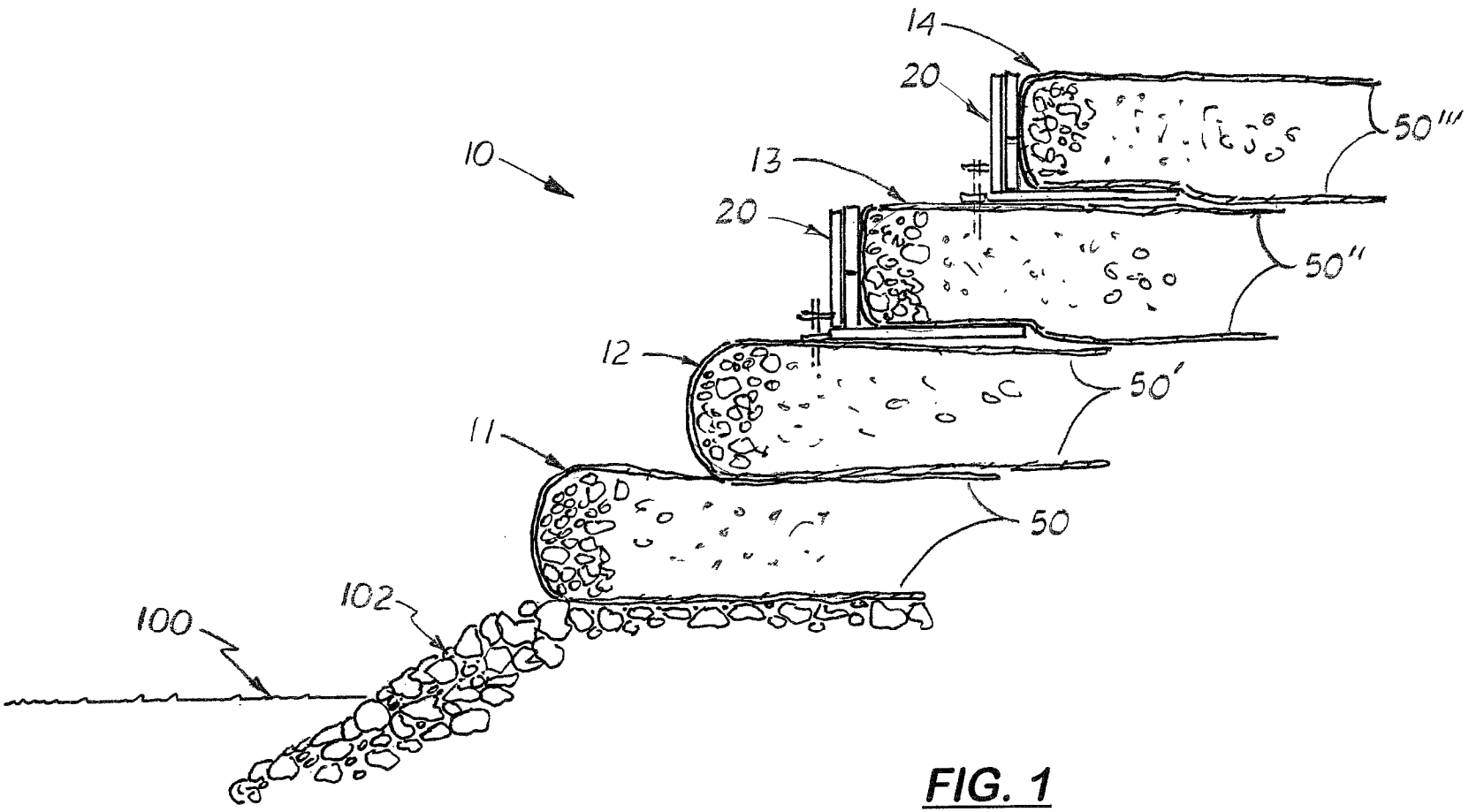
FIG. 1 is a side elevational view of a retaining wall being constructed of four stacked retaining wall tiers located adjacent to the bank of a stream.
Figure 3:
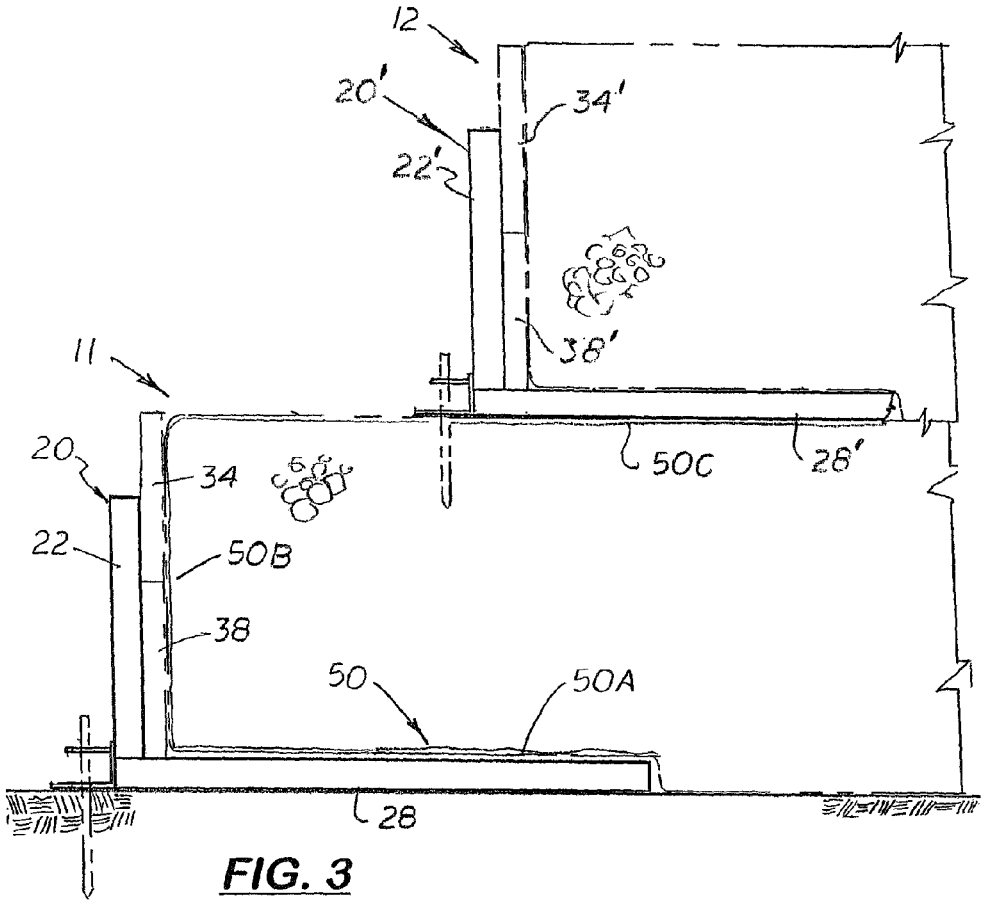
FIG. 3 is a side elevational view of two staked retainer wall tiers held in position by two brackets, two support boards, and two mesh cover panels.
Figure 4:
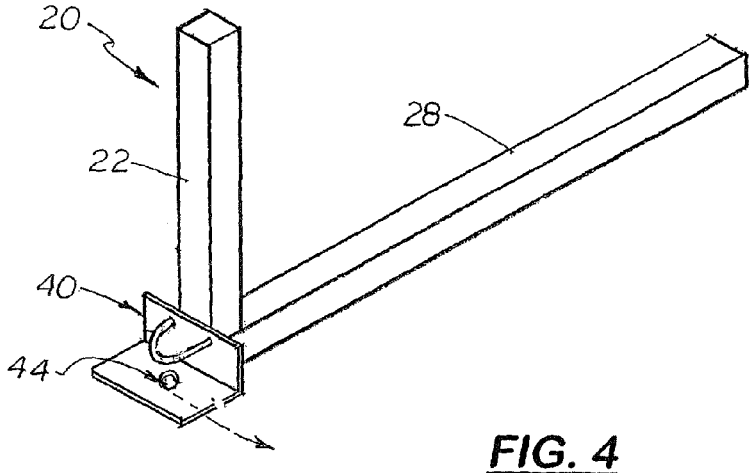
FIG. 4 is a perspective view of a bracket.

Referring to the accompanying Figs., there is shown an earth fill retaining wall system, generally indicated by the reference number 10, made up of a plurality of stepped and stacked retaining wall tiers 11, 12, 13, and 14 (see FIG. 1). Each retaining wall tier 11, 12, 13, and 14 are constructed using a plurality of removable brackets 20 that supports horizontally aligned support boards 34, 38 against the exposed middle section of a mesh cover panel 50 used to hold earth fill material 90. As shown more clearly in FIGS. 2-4, in the first embodiment, the bracket 20 is an L-shaped structure that includes a vertical post 22 and a perpendicularly aligned base 28 attached to its lower end. During assembly, the vertical post 22 is placed over the outside surface of two horizontally aligned form support boards 34, 38, stacked on edge over the inside corner of the base 28. Each bracket 20 is arranged on the ground so that the post 22 extends upward and the base 28 extends rearward into the space where the retaining wall 10 is to be constructed.

Also attached to the lower end of the post 20 and extending in the opposite direction of the base 28 is a flat U-shaped support shoe 40. A hole 44 is formed in the shoe 40 which is designed to receive a vertical stake or pin 48 manually driven into the ground to temporarily hold the bracket 20 in place.

Figure 2:
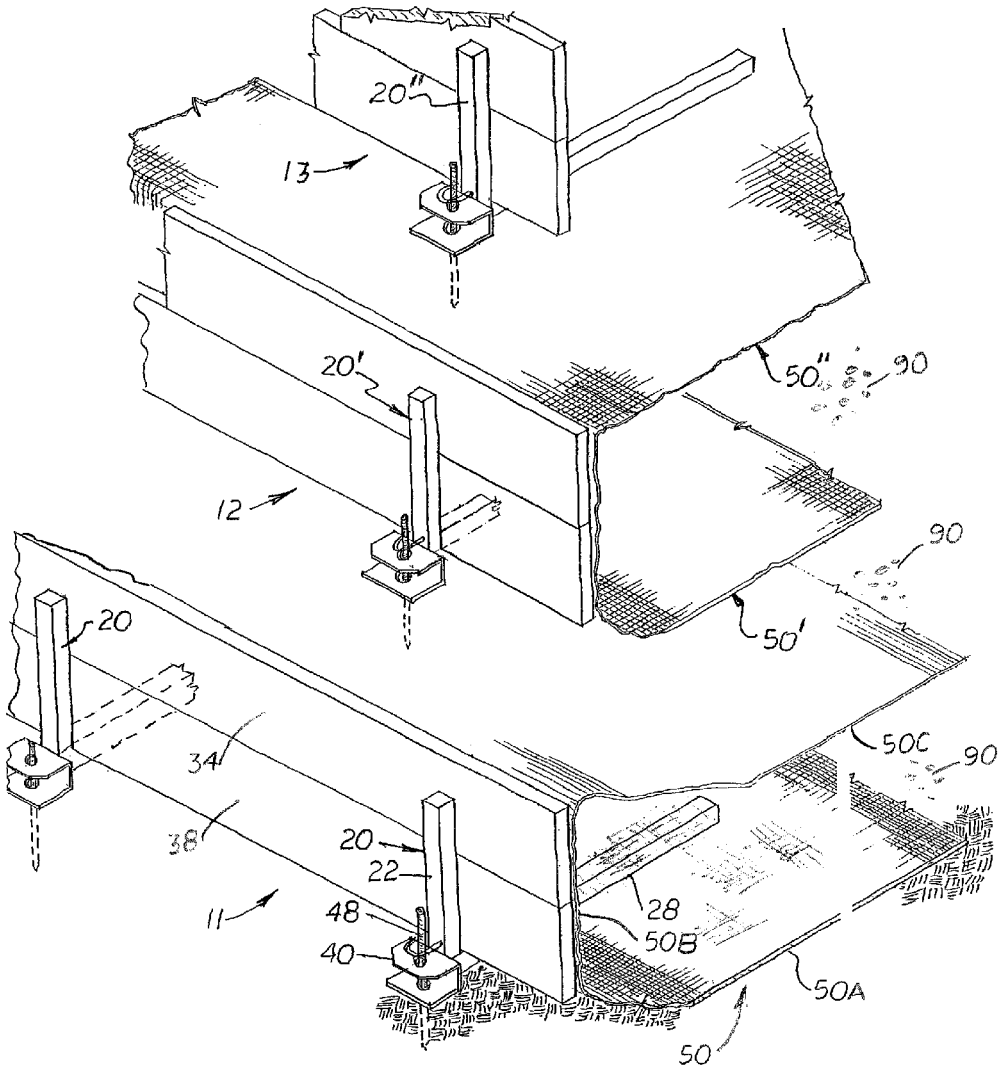
FIG. 2 is a perspective view of a section of a three tier retaining wall under construction.

Unfolded and partially extended in a forward direction over the base 28 and against the inside surfaces of the two support boards 34, 38 is a flexible mesh cover panel 50. As shown in FIG. 2, the lower section 50A of the mesh cover panel 50 is placed over the base 28 while the middle section 50B of the mesh cover panel 50 extends upward and covers the inside surface of the post 22 and the support boards 34, 38. The upper section 50C of the mesh cover panel 50 temporarily extends rearward as earth fill material 90 is placed over the upper section 50C of mesh cover panel 50.

Each tier 11, 12, 13, 14 is constructed from bottom to top. The earth fill material 90 used on a lower tier is used as a foundation base for an upper tier. As each tier 11, 12, 13, 14 is constructed, the earth fill material 90 is compacted with a roller (not shown). When the level of earth fill material 90 reaches the top of the post 20 or the edge of the top support board 34, the upper section 50C of the mesh cover panel 50 is then pulled upward and rearward and extends over the top layer of the earth fill material 90. Another bracket 20' is then selected and placed over the rear lower section 50A of the mesh cover panel 50 extending over the lower retaining wall tier. In the preferred embodiment, the new bracket 20' is placed inward from the front surface of the lower retaining wall layer to create a 'stepped' retaining wall. Another piece of mesh cover panel 50' and suitable amount of earth fill material 90 are then used to construct the stacked retaining wall tiers. The method is then repeated until the retaining wall reaches its desired height. In the preferred embodiment, the retaining wall 10 may be made up to five tiers.

Figure 5:
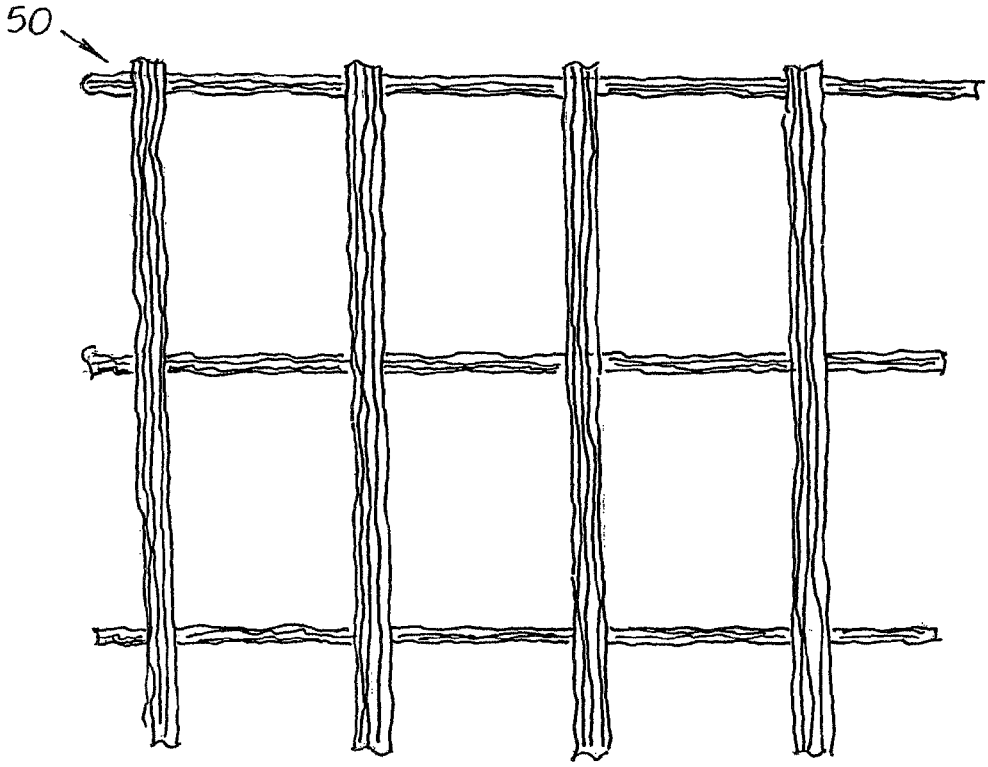
FIG. 5 is a top plan view of a small section of the mesh cover panel.
Figure 6:
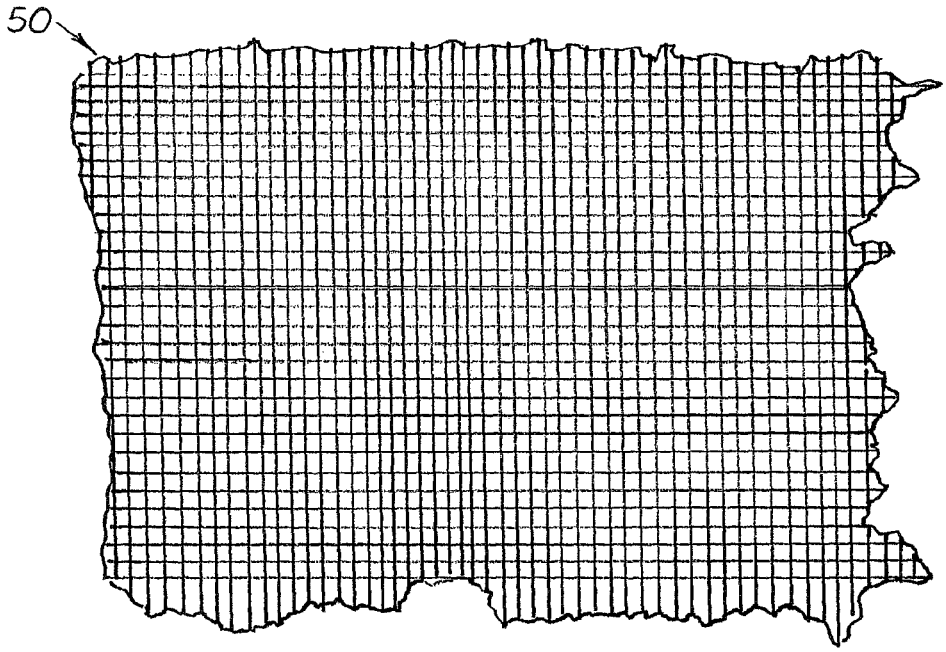
FIG. 6 is a top plan view of a small section of another embodiment of the mesh cover panel.

In the preferred embodiment, the flexible mesh cover panel 50 is made of synthetic material specifically designed for soil reinforcement. The mesh cover panel 50 may be a coarse grid-like structure as shown in FIG. 5 or a closed gird structure as shown in FIG. 6. The mesh cover panel 50 may also be a closed knitted panel structure (not shown). An example of the synthetic mesh material that can be used with the system is the mesh covers sold under the trademarks MIRAGRID XT, MIRAGRID 3XT or MIRAFI PET Series by TenCate GeoSynthetics located in Pendergrass, Ga. It should be understood however, other types of soil reinforcement mesh covers may be used with the system 10.

Figure 7:
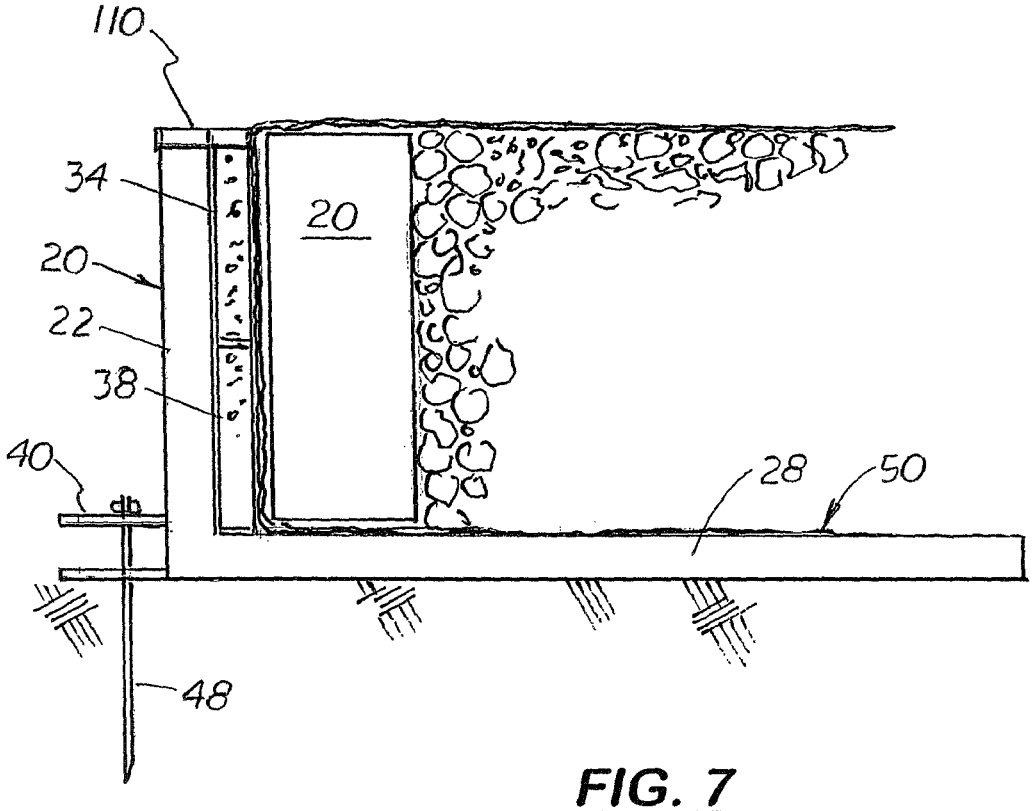
FIG. 7 is a sectional, side elevational view of a retainer wall tier held in position by one bracket, two support boards, a topsoil panel and a mesh cover panel.
Figure 8:
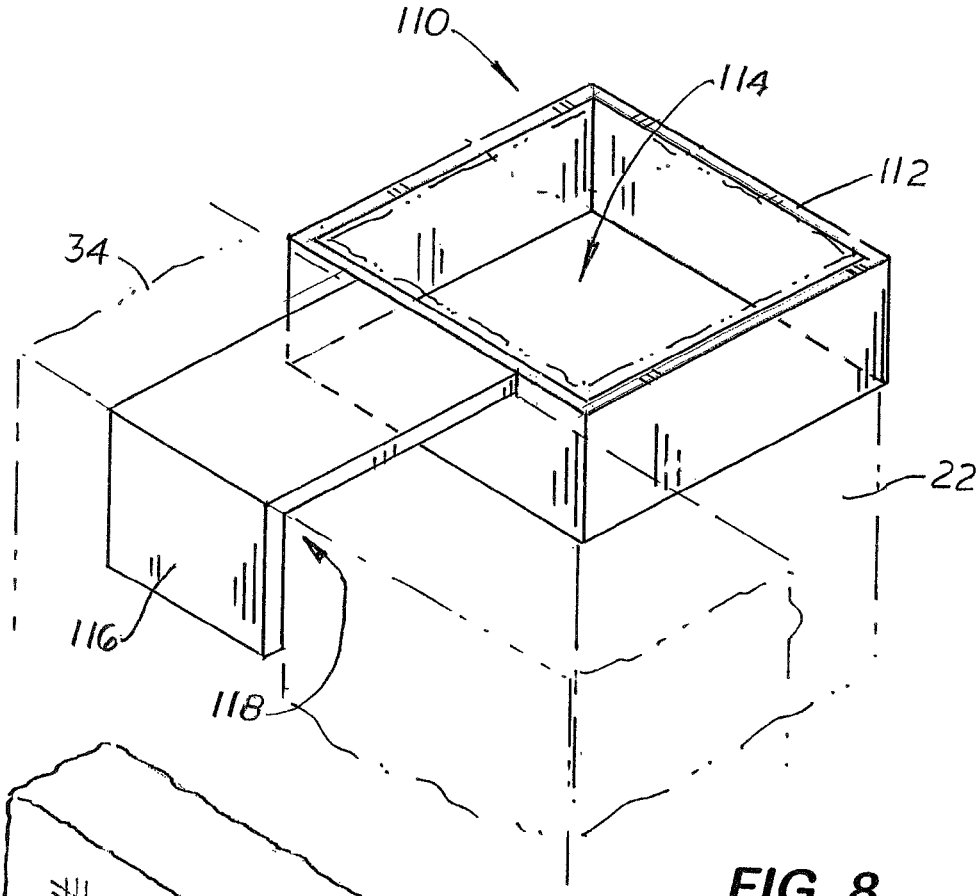
FIG. 8 is a perspective view of a support board engaging retainer clip.

FIG. 7 shows an alternative arrangement for constructing retaining wall layer that includes an upper clip 110 placed over the top end of the post 22 that is used to hold the top form board panel 34 vertically against the post 22. As shown in FIG. 8, the clip 110 includes a square-shaped body 112 designed to fit around the top end of the post 22. Attached to the body 112 is a downward facing, L-shaped lip 116 structure that fits over then top edge of the form board panel 34.

Figure 9:
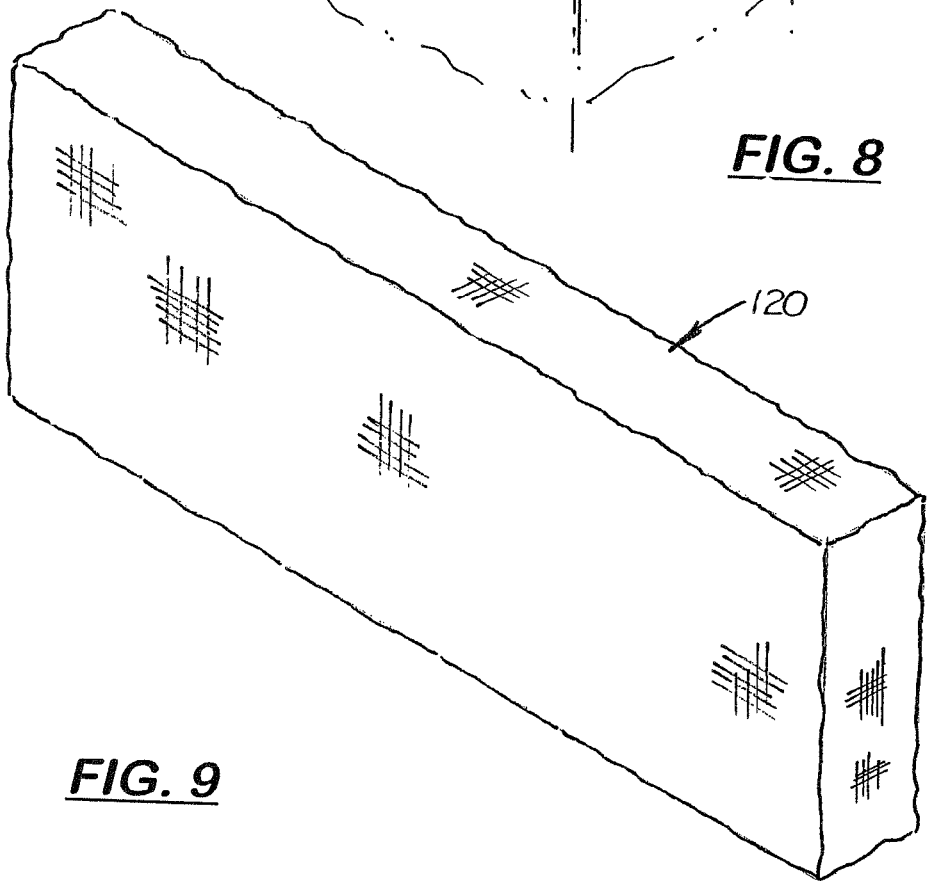
FIG. 9 is a perspective view of a topsoil panel shown in FIG. 7.

Also shown in FIG. 7 is the used of a plant growth topsoil panel 120 placed against the inside surface of the mesh cover panel 50 that is placed adjacent to the two form board boards 34, 38. As shown in FIG. 9, the panel 120 is an elongated, rectangular structure placed on edge and aligned vertically. The outer cover of the panel 120 is made of biodegradable material, cotton and inside filling is made of topsoil and coconut vegetation.

In the preferred embodiment, the post 22 and base 28 of the bracket 20 is made of steel square tubing approximate two inches in width with interior walls approximately ⅛ inch thick. The post 22 and base 28 measure approximately 24-36 inches in length, respectively. The shoe 40 is a U-shaped structure approximately two inches in width and three in length. The hole 44 formed in the shoe is approximately ⅝ inch in diameter. The stake 48 is approximately ½ inches in diameter and sixteen inches in length.

Figure 10:
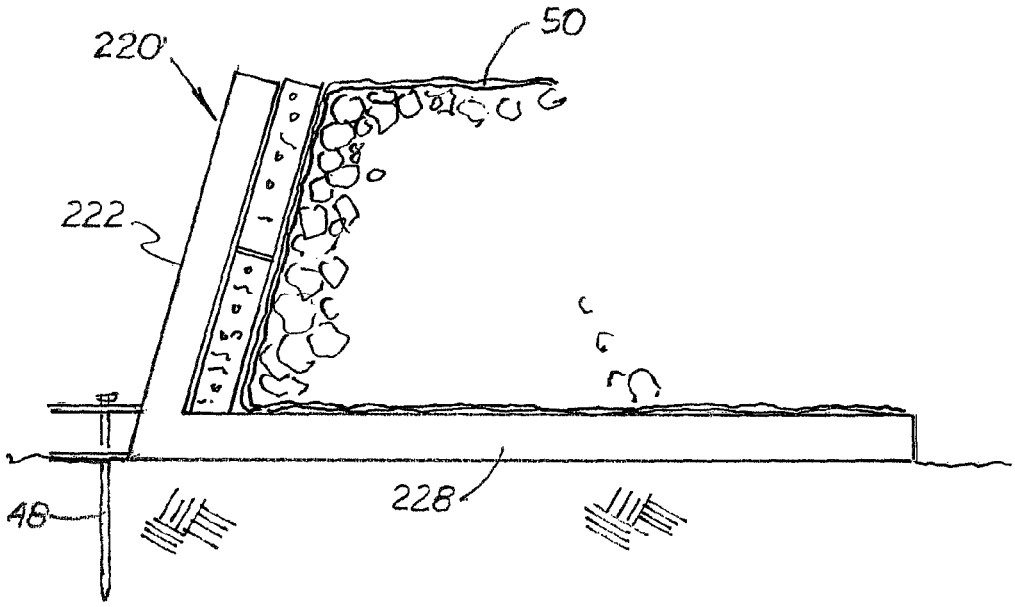
FIG. 10 is a sectional, side elevational view of a tier constructed with another embodiment of the bracket with a diagonally aligned post.

FIG. 10 is an alternative embodiment of the bracket 220 that includes a diagonally aligned post 222 attached to a straight, horizontally aligned base 228.

Figure 11:
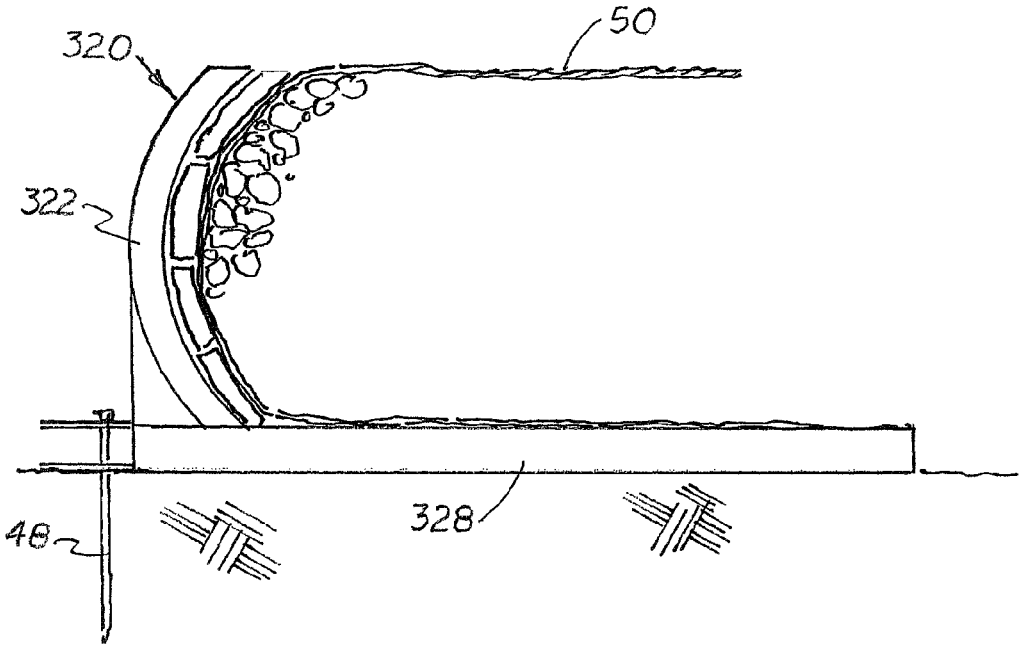
FIG. 11 is a sectional, side elevational view of a tier constructed with a third embodiment of the bracket with a curved post.

FIG. 11 is another alternative embodiment of the bracket 330 with a curved post 322.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

We claim:

1. A method for forming a multiple tier, earth fill retaining wall in an environmentally sensitive area made only of mesh cover panels and backfilled with earth fill material, said method comprising the steps of:

a. selecting an environmentally sensitive area where a multiple tier retainer wall is desired;

b. selecting at least two brackets each with a vertical post and a perpendicular base;

c. selecting at least one support panel, said support panel being sufficient it size to extend between said brackets setup at a desired location where a first said tier of said retaining wall is to be constructed;

d. attaching at least two brackets to the ground at the desired location where the first said tier is to be constructed, said brackets being spaced apart and being aligned so that said post extends upward and said base extends rearward into the area where the retaining wall is to be constructed;

e. disposing said support panel between two said brackets;

f. selecting a first piece of mesh cover panel used to form the first said first tier, said mesh cover panel includes a lower section, a middle section and an upper section, said lower section being disposed over and extending it over said bases of said brackets and said middle section being aligned adjacent and behind said support panel, and said upper section being extending above said support panel;

g. depositing earth fill material over the lower section of said mesh cover panel located over said base and against said middle section of said mesh cover panel adjacent to said support panels;

h. folding said upper section of mesh cover panel rearward and over said earth fill material when the height of the earth file material is at the desired height;

i. repeating steps b-h to construct upper tiers; and, j. removing said brackets and said support panels.

* * * * *